United States Patent [19]

Lohmann et al.

[11] 4,427,763

[45] Jan. 24, 1984

[54] PHOTOGRAPHIC RECORDING MATERIAL WITH A PRECURSOR COMPOUND FOR A YELLOW MASK

[75] Inventors: Joachim W. Lohmann, Odenthal; Günter Renner, Bergisch Gladbach; Wolfgang Sauerteig, Leverkusen, all of Fed. Rep. of Germany

[73] Assignee: Agfa-Gevaert Aktiengesellschaft, Leverkusen, Fed. Rep. of Germany

[21] Appl. No.: 412,863

[22] Filed: Aug. 30, 1982

[30] Foreign Application Priority Data

Sep. 12, 1981 [DE] Fed. Rep. of Germany ..... 3136293

[51] Int. Cl.[3] ..... G03C 1/76

[52] U.S. Cl. ..... 430/504; 430/359; 430/506; 430/509; 430/555; 430/562; 430/563; 430/955

[58] Field of Search ..... 430/359, 504, 506, 509, 430/555, 562, 955, 563

[56] References Cited

U.S. PATENT DOCUMENTS

| | | | |
|---|---|---|---|
| 3,476,564 | 11/1969 | Mariani et al. | 430/555 |
| 3,658,536 | 4/1972 | Wolf | 430/506 |
| 3,684,513 | 8/1972 | Pelz et al. | 430/562 |
| 4,061,498 | 12/1977 | Monbaliu et al. | 430/555 |
| 4,062,683 | 12/1977 | Monbaliu et al. | 430/558 |
| 4,163,670 | 8/1979 | Shiba et al. | 430/555 |

*Primary Examiner*—J. Travis Brown

*Attorney, Agent, or Firm*—Connolly and Hutz

[57] ABSTRACT

A color photographic recording material, in which a precursor compound for a yellow mask coupler is contained in a green-sensitive layer or in a layer adjacent thereto and in which a blue-sensitive layer is arranged between this layer and the layer support, permits very good sharpness with satisfactory speed.

6 Claims, 5 Drawing Figures

PHOTOGRAPHIC RECORDING MATERIAL WITH A PRECURSOR COMPOUND FOR A YELLOW MASK

This invention relates to a colour photographic recording material with several silver halide emulsion layers and optionally other layers, of which at least one contains a precursor compound for a yellow mask coupler.

In most colour photographic processes, the colours are produced by chromogenic development. In this case, the colour developer oxidised during development of the silver image reacts with so-called colour couplers to form dyes. The colour reproduction has a few fundamental defects owing to the fact that the dyes produced do not absorb only in the desired range. For example, the magenta dyes produced by development in colour negative materials do not absorb only green light, as desired, but also blue light due to a secondary yellow density. A colour negative with such a dye therefore does not absorb only the green print light but also some of the blue print light during the printing process.

If no adequate measures are taken, less than the necessary quantity of blue light reaches the print material during the printing process, owing to the unwanted absorption of the magenta. This unwanted absorption may be compensated for by using a yellow coloured mask dye. For this purpose, there is generally produced in the actual negative an integral yellow image which is inverse to the magenta partial dye image and to the undesired secondary density of the magenta dye and of which the colour density must be adjusted in such a way that the sum of the yellow density of the mask and the yellow secondary colour density of the magenta dye is constant and may be compensated by a filter during the printing operation. Such masks are formed automatically, for example when using in the magenta layer or in a layer associated with the magenta layer yellow coloured couplers bearing at the coupling position of the molecule a dye-producing radical which is split off during colour coupling with the developer oxidation product. After the reaction with the developer oxidation product, either a colourless compound or a magenta dye is generally obtained. A conventional magenta coupler is generally contained in the magenta layer in addition to the yellow-coloured mask coupler. During development, a magenta image which is negative with respect to the subject of the photograph and, at the same time, a yellow positive image composed of the unreacted mask coupler, namely the mask image, are obtained in the emulsion layer.

Figure 1:
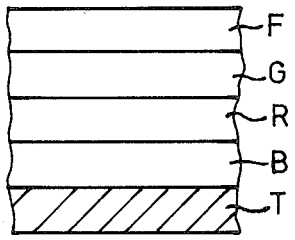
Figure 2:
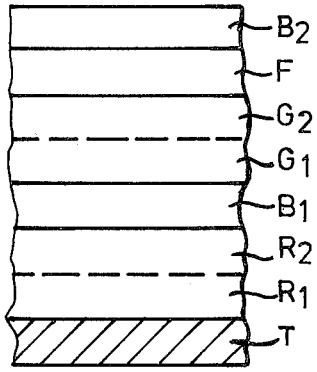

The yellow mask couplers are generally contained in the green-sensitive layer, in which magenta dyes are formed. Colour photographic materials, in particular colour negative materials, generally have a structure in which at least one red-sensitive layer, one green-sensitive layer, one yellow filter layer and one blue-sensitive layer are applied to a support in the sequence indicated. With this arrangement, each of the light-sensitive layers can also comprise two or more individual layers, and one layer may be faster than the other. As the human eye has the greatest resolving power in the green range of the spectrum, the image produced in the green-sensitive layer exerts the greatest influence on the subjectively perceived sharpness. However, with the conventional structure described above, the sharpness of the image produced in the green-sensitive layer suffers from the dispersion of light within the layers located above the green-sensitive layer. In order to improve the sharpness, it has therefore already been proposed that the green-sensitive layer be arranged above the blue-sensitive layer. Such structures are described, for example, in German Offenlegungsschrift No. 2,427,491, British Pat. No. 1,430,509, German Auslegeschrift No. 1,128,291 and U.S. Pat. No. 2,344,084. FIG. 1 shows the layer structure of the Example from German Auslegeschrift No. 1,128,291. In this Figure, there are located on a base (T) a blue-sensitive layer (B), superimposed by a red-sensitive layer (R), a green-sensitive layer (G) and, as top layer, a yellow filter layer (F). With such a structure, a very large proportion of the blue light does not reach the blue-sensitive layer as it is absorbed in the layers on top of it. The yellow filter layer absorbs a very large proportion, but layers (G) and (R) are also absorbent owing to the inherent absorption of the silver halide in the blue range of the spectrum. If, as normal in modern materials, an additional yellow-coloured coupler (mask coupler) were used in the green-sensitive layer (G) to compensate the undesired secondary yellow density of the magenta image formed after exposure and development, a further large proportion of the blue light would also be absorbed by the yellow mask coupler. In this case, the layer structure would be even slower than otherwise. The layer arrangement according to FIG. 2, known from U.S. Pat. No.3,658,836, represents a certain improvement. On a base (T) there are located a red-sensitive layer with the layer elements ($R_1$) and ($R_2$), a blue-sensitive layer ($B_1$) and a green-sensitive layer with the layer elements ($G_1$) and ($G_2$). The layer (F) is a yellow filter layer above which the upper blue-sensitive layer ($B_2$) is arranged.

If yellow-coloured mask couplers are contained in the layers ($G_1$) and ($G_2$), blue light has to pass through three yellow-coloured layer elements in this layer structure, namely the layers (F), ($G_2$) and ($G_1$), in order to reach the lower blue-sensitive layer ($B_1$). The loss of speed in the layer ($B_1$) is accordingly high since blue light is absorbed by the yellow layers. As a result, suitable arrangements either exhibit a coarse graininess in the yellow partial dye image or a low overall speed.

It is known from British Pat. No. 853,922 that yellow-coloured couplers can be converted into magenta-coloured couplers by hydrolysis in an alkaline solution. British patent application No. 2,036,994 discloses a photographic recording material which contains in one layer a dye or another compound of which the spectral absorption is shifted by elimination of a radical as a result of an intramolecular nucleophilic displacement reaction. Colour couplers are mentioned as examples of compounds having shifted absorption. However, the last-mentioned literature references contain no indication as to how the disadvantages of the layer structure described in U.S. Pat. No. 3,658,836 should be avoided when using yellow-coloured mask couplers.

An object of the present invention is to prepare a colour photographic recording material with improved sharpness and good sensitivity.

A colour photographic recording material having a layer support and at least one blue-sensitive, at least one red-sensitive and at least one green-sensitive layer has accordingly been found, in which at least one blue-sensitive layer is interposed between the layer support and at least one green-sensitive layer (G). According to the invention, this layer (G) contains at least one precursor compound for a yellow mask coupler, the maximum absorption $\eta_{max}$ of the precursor compound being shifted to a shorter wavelength as compared with the corresponding mask coupler. The precursor compound absorbs either virtually no blue light or significantly less than the yellow mask coupler. In a preferred embodiment, the maximum absorption of the precursor compound is at a wavelength at least 20 nm especially at least 50 nm shorter than the maximum absorption of the corresponding yellow mask coupler.

The precursor compound preferably contains a substituent R which can be eliminated by hydrolysis in an alkaline aqueous medium yielding the yellow mask coupler by elimination of the substituent R. The precursor compounds include, in particular, pyrazolinones and compounds derived from pyrazolinone. The substituent R is preferably an acyl radical.

Acyl radicals are, in particular, understood to be those which are derived from carboxylic acids and sulphonic acids including carbonic acid esters, carbamic acids and sulphamic acids.

Particularly preferred precursor compounds correspond to at least one of the following formulae:

(I)

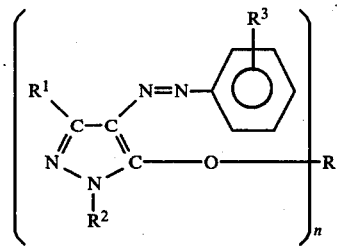

(II)

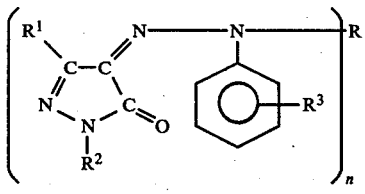

(III)

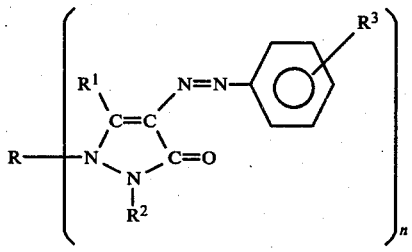

(IV)

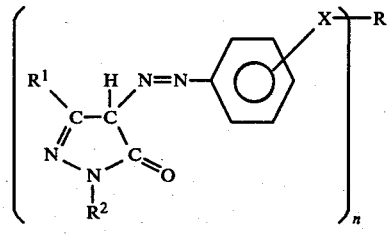

In these formulae, $R^1$ to $R^3$ represent substituents usual for yellow mask couplers in photographic materials, X represents —O—, —$NR^4$—, —S— in the ortho and/or para position, $R^4$ represents hydrogen or alkyl, n represents 1 or 2; and R represents a mono- or divalent acyl radical.

The radical R is generally split off at pH values exceeding 9 by hydrolysis. It is, in particular, the radical of a carboxylic or sulphonic acid, carbonic acid or a carbonic acid derivative.

R is, in particular, the acyl radical of a dicarboxylic acid containing from 3 to 10 carbon atoms, benzoyl, in particular nitro- or cyanobenzoyl, or the acyl radical of an aliphatic monocarboxylic acid containing from 2 to 5 carbon atoms, in particular acetyl.

R is also preferably the acyl radical of a carbonic acid monoester of an aliphatic alcohol preferably containing from 1 to 4 carbon atoms or of an aromatic alcohol, specifically ethoxycarbonyl and phenoxycarbonyl.

R is also preferably the radical of an aromatic or aliphatic sulphonic acid, in particular toluene sulphonic acid, benzene sulphonic acid and butane sulphonic acid.

In another preferred embodiment, R is an acyl radical which is cleaved from the compound owing to an intramolecular nucleophilic displacement reaction. Such radicals preferably contain at one end an electrophilic group E by means of which the bond to the actual yellow mask is effected. This electrophilic group is generally connected via a linking group to a precursor group NuP of a nucleophilic group. The precursor group NuP is converted into a nucleophilic group Nu in the alkaline medium. R is eliminated from the molecule as a consequent reaction. Such radicals R are known and described, for example, in British patent application No. 2,036,994.

The value of n is preferably 2 if R is the radical of a dicarboxylic acid. n preferably has the value 1 in other cases.

$R^1$ preferably represents alkyl, in particular with 1 to 22 atoms, substituted alkyl, aryl, substituted aryl, anilino or anilino substituted by one or more of the conventional groups such as alkyl, alkoxy, alkylthio, aryloxy, halogen such as chlorine, nitro, cyano, sulpho, sulphamoyl, carbamoyl, amino, substituted amino, for example acylamino, the acyl radical being derived from aliphatic or aromatic carboxylic or sulphonic acids, such as acetylamino, propionylamino, acrylamino, methacrylamino, palmitoylamino and benzoylamino, optionally with one or more conventional substituents on the phenyl ring, for example halogen such as chlorine and bromine, alkyl such as methyl, alkoxy such as methoxy, ethoxy, hexadecyloxy, aroxy such as phenoxy and substituted phenoxy, acyl amino such as acetylamino, phenoxyacetylamino, α-(2,4-di-t-amylphenoxy)-acetylamino.

$R^2$ preferably represents a substituent of the type conventional in colour couplers of the pyrazoline-5-one series, preferably an alkyl group containing from 1 to 22, in particular from 1 to 5 carbon atoms which may be substituted, for example by halogen, cyano or phenyl, the phenyl group in turn being further substituted or, in particular, an aryl group, for example phenyl, which may bear one or more substituents such as alkyl, for example methyl, halogen, for example chlorine or bromine, sulpho, alkoxy, for example methoxy, phenoxy, alkyl sulphonyl, for example methyl sulphonyl, alkylthio, for example methylthio, carbalkoxy, haloalkoxy, haloalkylthio, haloalkyl sulphonyl, sulphamyl, carbamyl, cyan or nitro.

$R^3$ preferably represents one or also several substituents of the type conventional in yellow mask couplers, preferably a hydrogen atom, an alkyl group containing from 1 to 22 carbon atoms which may be substituted, for example by halogen, cyano or phenyl, an aryl group which may bear one or more substituents, an alkoxy group, a phenoxy group, an alkyl sulphonyl group, an alkylthio group, a sulphamyl group, a carbamyl group, a cyano group, a nitro group, a hydroxy group or halogen.

The precursor compound for the yellow mask coupler is generally contained in the same molar concentration as yellow mask couplers conventionally contained in the green-sensitive layer. It is preferable to use from 50 mg to 250 mg of the precursor compound per mole of silver halide in the green-sensitive layer. The precursor compound is generally contained in the green-sensitive silver halide emulsion layer itself, but may also be located in a layer adjacent thereto. If there are several green-sensitive layers, the precursor compound is preferably located in all green-sensitive layers. Particularly preferred precursor compounds correspond to the following formulae 1 to 12.

1

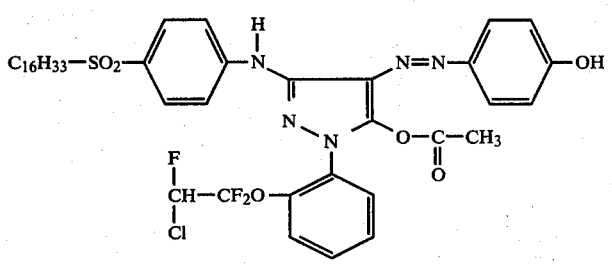

2

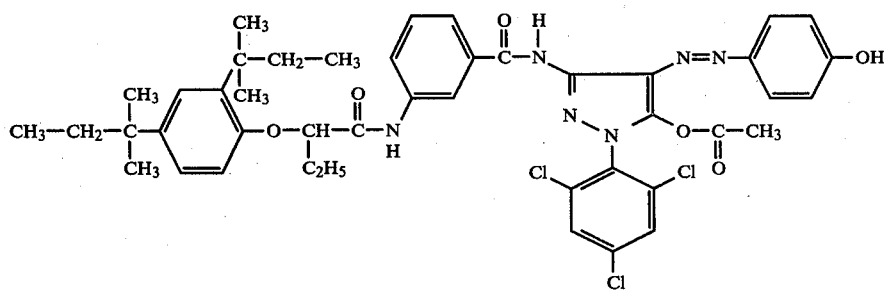

3

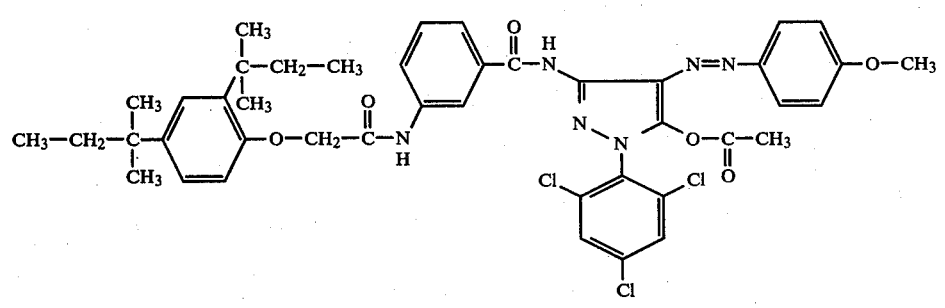

4

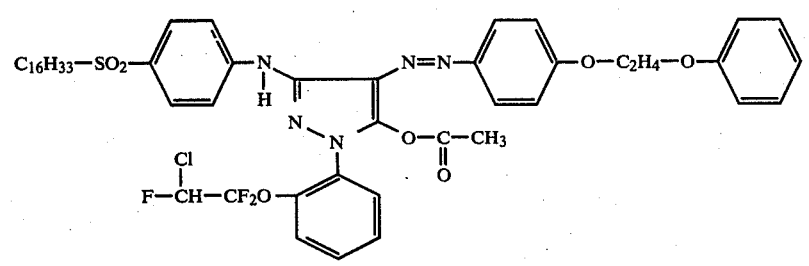

-continued
5
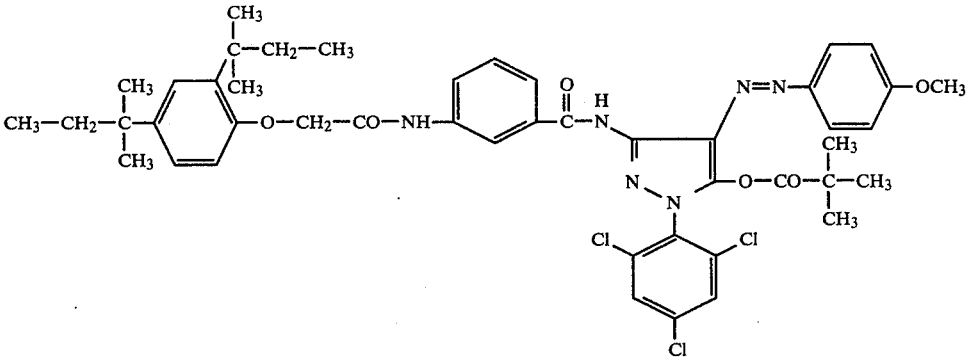
6
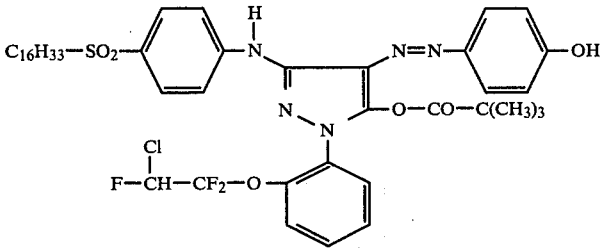
7
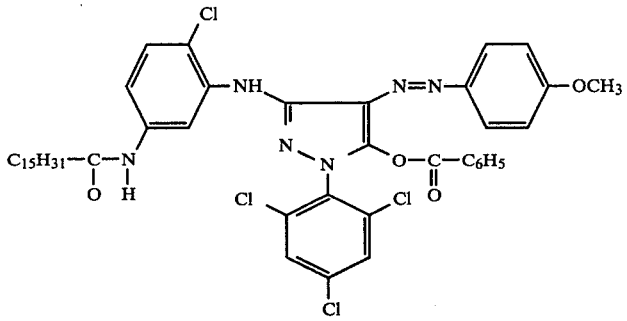
8
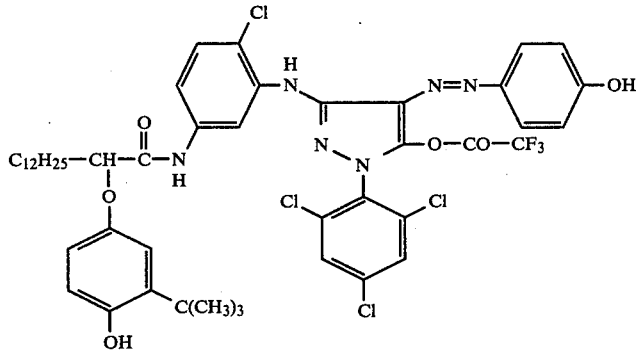
9
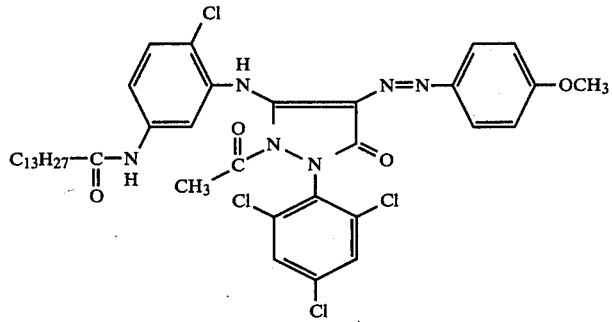

-continued

10

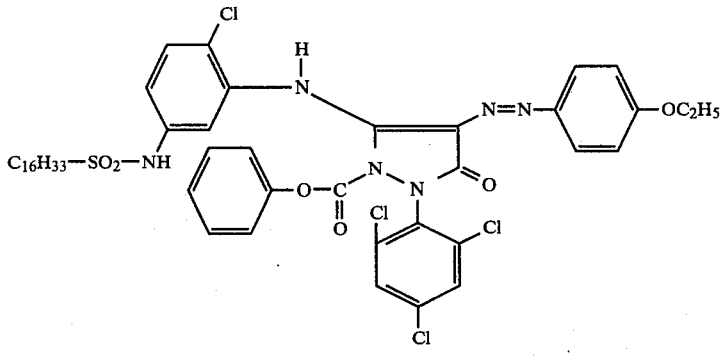

11

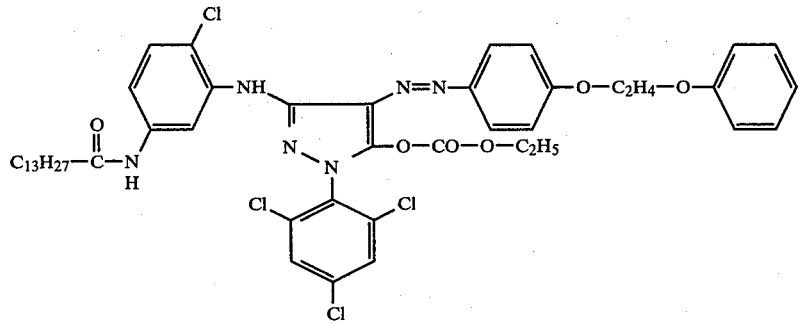

12

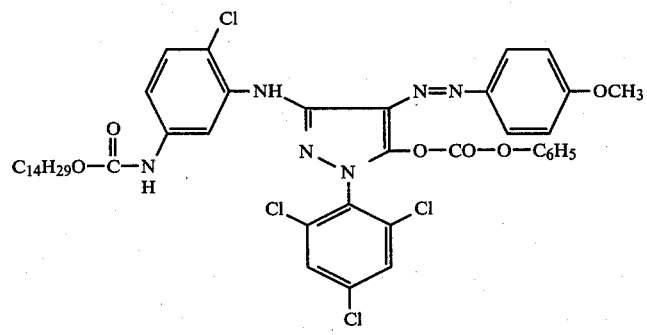

Compounds corresponding to formula (I) are known from U.S. Defensive Publication No. 887,007, German Offenlegungsschrift No. 2,523,882 and U.S. Pat. No. 4,062,683. Compounds corresponding to formula (III) are known from German Offenlegungsschrift No. 2,524,123 and U.S. Pat. No. 4,061,498. The compounds corresponding to formula (II) are obtained by acylation of a conventional yellow mask coupler by means of acid chloride in a dipolar solvent having basic properties such as, for example, dimethylformamide, dimethylacetamide and N-methyl pyrrolidone, without the use of an auxiliary base. Compounds corresponding to formula (IV) are obtained by acylation of a suitable yellow mask by means of an acid chloride or an anhydride in an aprotic solvent, using the sodium or potassium salt corresponding to the acylation agent as acid collector.

Figure 5:
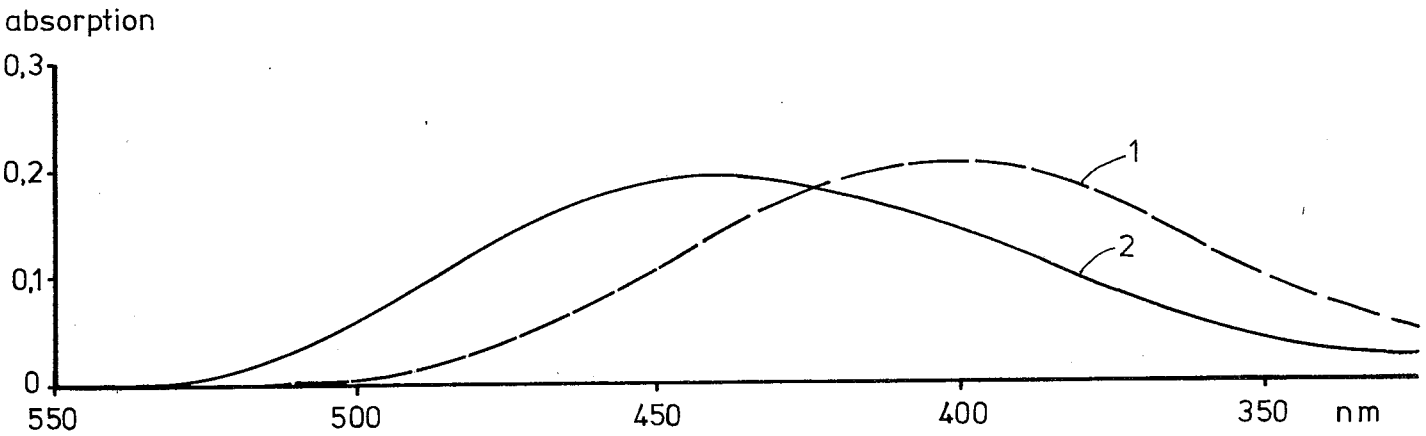

The precursor compounds to be used according to the invention do not absorb blue light at all or absorb it significantly less than the corresponding yellow mask couplers. Reference is made to FIG. 5 showing the absorption of the precursor compound no. 2 (curve 1) and of the corresponding yellow mask coupler (curve 2).

This variation in the absorption is achieved in a preferred embodiment, for example with the compounds corresponding to formulae (I) to (IV), by substitution with a suitable substituent (R). The substituent R is split off by hydrolysis in the alkaline medium, i.e. generally in the developer bath. This elimination does not take place imagewise, but with all precursor compounds present in the material. Initially, therefore, a uniform yellow coloration is obtained, corresponding to the yellow coloration previously obtained when using a conventional yellow mask coupler. The remaining stages are completed as with materials having a conventional yellow mask, i.e. the developer oxidation product reacts imagewise in the exposed areas with the yellow mask coupler now present, whereby the yellow density of the mask coupler disappears imagewise. On the other hand, the yellow mask coupler is retained in the unexposed areas where there is no developer oxidation product present.

It is therefore possible according to the invention to employ the advantages of yellow mask couplers in green-sensitive layers without substantial loss of speed even in photographic materials in which there is a green-sensitive layer above a blue-sensitive layer, in order to obtain increased sharpness by this arrangement. The precursor compound of the yellow mask coupler present in the green-sensitive layer does in fact absorb much less blue light than the corresponding mask coupler, so more blue light can reach the lower blue-sensitive layer.

In a preferred embodiment of the material according to the invention, the following layers are applied in the sequence indicated to a layer support, and additional layers, in particular auxiliary layers, may be located beneath, between or above these layers:

1. a red-sensitive layer,
2. a low speed blue-sensitive layer,
3. a green-sensitive layer (G),
4. a high speed blue-sensitive layer.

A yellow filter layer may be located between the green-sensitive layer (G) and the high speed blue-sensitive layer, to absorb blue light.

In another preferred embodiment, the green-sensitive layer (G) comprises at least two layer elements ($G_1$) and ($G_2$) of differing speed. Similarly, the red-sensitive layer can comprise at least two layer elements ($R_1$) and ($R_2$) of differing speed.

The two blue-sensitive layers ($B_1$) and ($B_2$), like the two green-sensitive layer elements ($G_1$) and ($G_2$) and the two red-sensitive layer elements ($R_1$) and ($R_2$), are preferably adapted to each other in speed so that D-log E curves having a substantially linear path are formed for all of them.

In a preferred embodiment, the low speed red-sensitive and the green-sensitive layers are closer to the layer support than the corresponding faster layers.

The light-sensitive silver halide emulsion layers are generally provided with non-diffusible colour couplers capable of reacting with the colour developer oxidation products to form a non-diffusible dye.

The non-diffusible colour couplers are preferably arranged in the actual light-sensitive layer or adjacent thereto.

The colour couplers optionally allocated to the two or more layers of equal spectral sensitivity need not necessarily be identical. They should merely produce the same colour during colour development, normally a colour which is complementary to the colour of the light to which the light-sensitive silver halide emulsion layers are sensitive. The red-sensitive silver halide emulsion layers are normally provided with at least one respective non-diffusible colour coupler to produce the cyan partial dye image, generally a coupler of the phenol or $\alpha$-naphthol type. The green-sensitive silver halide emulsion layers normally contain at least one respective non-diffusible colour coupler to produce the magenta partial dye image, colour couplers of the 5-pyrazolone, the indazolone or the pyrazolobenzimidazole type generally being used. Finally, the blue-sensitive silver halide emulsion layers normally contain at least one respective non-diffusible colour coupler to produce the yellow partial dye image, generally a colour coupler with an open-chained $\beta$-diketomethylene or $\beta$-diketomethine grouping. Many colour couplers of these types are widely known and described in a number of patents. By way of example, reference is made here to the publications "Farbkuppler" by W. Pelz in "Mitteilungen aus den Forschungslaboratorien der Agfa, Leverkusen/Munchen", Volume III, page 111 (1961), K. Venkataraman in "The Chemistry of Synthetic Dyes", Volume 4, pages 341 to 387, Academic Press (1971), and T. H. James, "The Theory of the Photographic Process", 4th Edition, pages 353 to 362.

The colour couplers may be conventional 4-equivalent couplers as well as 2-equivalent couplers in which case a smaller quantity of silver halide is needed for dye production. 2-equivalent couplers are known to be derived from the 4-equivalent couplers since they contain in the coupling position a substituent which is eliminated during the coupling process. The 2-equivalent couplers also include the known white couplers which, however, do not produce a dye during the reaction with colour developer oxidation products. The 2-equivalent couplers also include the known DIR couplers which are couplers containing in the coupling position a removable radical which is liberated as a diffusible development inhibitor during the reaction with colour developer oxidation products.

If necessary, it is possible to use colour coupler mixtures in order to adjust a desired hue or a desired reactivity. For example, water-soluble couplers can be used in combination with hydrophobic water-insoluble couplers.

With respect to further suitable additives to the colour photographic recording materials according to the invention or to one of its layers, reference is made to the article in the journal "Product Licensing Index", Volume 92, December, 1971, pages 107 to 110.

The silver halide emulsions used in the materials according to the invention may contain chloride, bromide and iodide and mixtures thereof as the halide. It is preferable to use bromide and bromide-iodide emulsions.

The emulsions are preferably chemically sensitized for example by addition of sulphur-containing compounds during chemical maturing, for example allyl isothiocyanate, allylthiourea and sodium thiosulphate. Suitable chemical sensitisers also include reducing agents, for example the tin compounds described in Belgian Patent Nos. 493,464 or 568,687, also polyamines such as diethylene triamine or aminomethyl sulphinic acid derivatives, for example according to Belgian Patent No. 547,323. Noble metals and noble metal compounds such as gold, platinum, palladium, iridium, ruthenium or rhodium are also suitable as chemical sensitisers. It is also possible to sensitise the emulsions with polyalkylene oxide derivatives, for example with polyethylene oxide having a molecular weight between 1,000 to 20,000, also with condensation products of alkylene oxides and alcohols, aliphatic carboxylic acids, aliphatic amines, aliphatic diamines and amides.

The emulsions may be optically sensitised in a manner known per se, for example using the conventional polymethine dyes such as neutrocyanines, basic or acidic carbocyanines, rhodacyanines, hemicyanines, styryl dyes, oxonoles and the like. These sensitisers are described in the work by F. M. Hamer "The Cyanine Dyes and related Compounds" (1964). In this respect, reference is made, in particular, to "Ullmanns Enzyklopadie der technischen Chemie", 4th Edition, Volume 18, pages 431 et seq.

Azaindenes, preferably tetra or pentaazaindenes, in particular those substituted with hydroxyl or amino groups, are particularly suitable as stabilisers. These compounds are described, for example, in the article by Birr, "Z.Wiss.Phot." 47 (1952), pages 2 to 58. Other suitable stabilisers include heterocyclic mercapto compounds, for example phenylmercaptotetrazole, quaternary benzothiazole derivatives and benzotriazole.

The layers of the photographic material may be hardened in the conventional manner, for example with formaldehyde, with hardeners of the epoxide type, the heterocyclic ethylene imine and the acryloyl type. Furthermore, it is possible to harden the layers according to the process described in German Offenlegungsschrift No. 2,218,009, in order to obtain colour photographic materials suitable for high temperature processing. It is also possible to harden the photographic layers or the colour photographic multilayer materials with hardeners of the diazine, triazine, or 1,2-dihydroquinoline series or with hardeners of the vinyl sulphone type.

Suitable colour developer substances for the material according to the invention include, in particular, those of the p-phenylene diamine type, for example: N,N-dimethyl-p-phenylenediamine, 4-amino-3-methyl-N-ethyl-N-methoxyethylaniline, 2-amino-5-diethylaminotoluene, N-butyl-N-ω-sulphobutyl-p-phenylenediamine, 2-amino-5-(N-ethyl-N-β-methanesulphonamidethyl-amino)toluene, N-ethyl-N-β-hydroxyethyl-p-phenylenediamine, N,N-bis-(β-hydroxyethyl)-p-phenylenediamine, 2-amino-5-(N-ethyl-N-β-hydroxyethylamino)-toluene. Other suitable colour developers are described, for example, in J. Amer. Chem. Soc. 73, 3100 (1951).

After development of the dye, the material is usually bleached and fixed. Bleaching and fixing may be carried out separately from each other or also together.

The conventional compounds can be used as bleaching agents, for examples $Fe^{3+}$ salts and $Fe^{3+}$ complex salts such as ferricyanides, dichromates, water-soluble cobalt complexes etc. Iron-III-complexes of aminopolycarboxylic acids are particularly preferred, in particular, for example, ethylenediaminetetraacetic acid, nitrilotriacetic acid, iminodiacetic acid, N-hydroxyethylene diamine triacetic acid and of suitable phosphonic acids.

EXAMPLE

For comparison purposes, the following layer structures were produced, in which the said layers were applied in the specified sequence to a transparent layer support with an antihalation layer. The specified quantities are each based on 1 $m^2$. The corresponding quantities of $AgNO_3$ are specified for the silver coating.

Structure 1 (Comparison material)

1. A slow red-sensitive layer $R_{11}$ with a red-sensitised silver bromide-iodide emulsion containing 790 mg of a cyan coupler corresponding to the formula

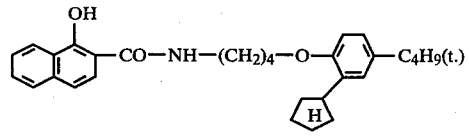

25 mg of a DIR coupler corresponding to the formula

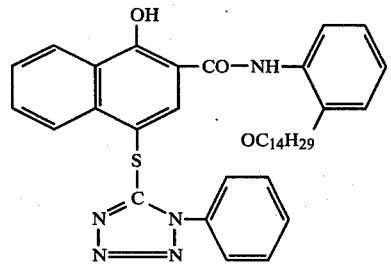

31 mg of a conventional red mask, and 1.6 g of gelatine. Silver coating: 3.0 g.

2. A fast red-sensitive layer $R_{12}$ with a red-sensitised silver bromide-iodide emulsion containing 250 mg of the cyan coupler from layer $R_{11}$, 30 mg of a red mask and 1.0 g of gelatine. Silver coating: 2.0 g.
3. An intermediate layer Z containing 0.7 g of gelatine.
4. A slow green-sensitive layer $G_{11}$ with a green-sensitised silver bromide-iodide emulsion containing 860 mg of a magenta coupler corresponding to the formula

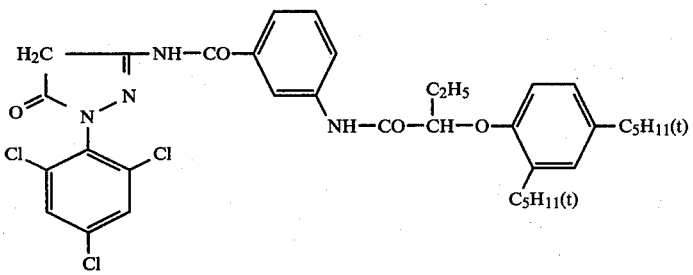

with 20 mg of a DIR coupler with 118 mg of a yellow mask coupler corresponding to the formula

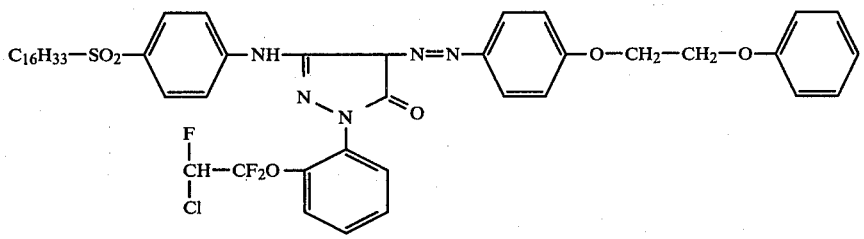

and 3.1 g of gelatine. Silver coating: 3.3 g.

5. A fast green-sensitive layer $G_{12}$ with a green-sensitised silver bromide-iodide emulsion containing 60 mg of the magenta coupler from layer 4, with 25 mg of the mask coupler from layer 4 and with 0.7 g of gelatine. Silver coating: 1.3 g.
6. An intermediate layer Z containing 0.7 g of gelatine.
7. A yellow filter layer F containing colloidal silver to produce a yellow density of 0.6.
8. A slow blue-sensitive layer $B_{11}$ with a silver bromide-iodide emulsion containing 1.6 g of a yellow coupler corresponding to the formula

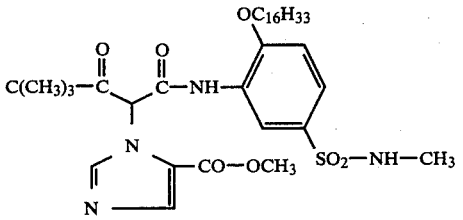

and with 1.7 g of gelatine. Silver coating 1.0 g.
9. A fast blue-sensitive layer $B_{12}$ with a silver bromide-iodide emulsion containing 200 mg of the yellow coupler from layer 8 and with 0.7 g of gelatine. Silver coating: 0.5 g.
10. A protective layer S consisting of 0.7 g of gelatine.

Figure 3:
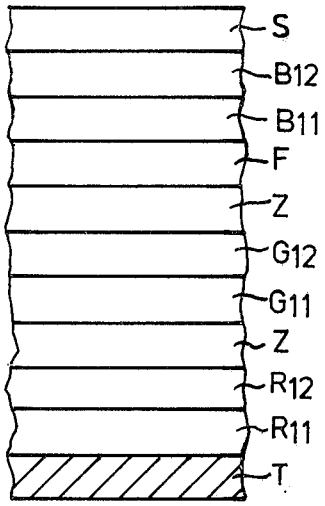

The structure of this material is illustrated in FIG. 3.

Structure 2

Figure 4:
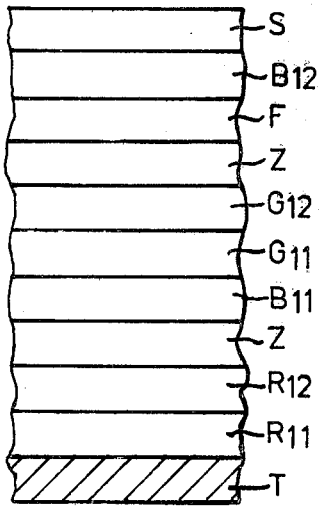

Structure 2 corresponds to structure 1 with the exception that the slow blue-sensitive layer $B_{11}$ is not arranged between the yellow filter layer F and the fast blue-sensitive layer $B_{12}$ but directly beneath the slow green-sensitive layer $G_{11}$. This structure is shown in FIG. 4.

Structure 3, invention

Another photographic material with the same structure as that specified under structure 2 is produced, with the exception that the corresponding molar quantity of the precursor compound No. 4 is used instead of the mask coupler in the layer $G_{11}$.

Structure 4, invention

A structure as specified under structure 3 is produced, with the exception that the yellow density in the yellow filter layer F is increased from 0.6 to 1.0.

The specified structures were exposed imagewise in the conventional manner and subjected to colour photographic processing, as known form "The British Journal of Photography", July 1974, pages 597 and 598.

The sharpness (measured as a modulation transfer function of the green-sensitive layer packet; local frequency in I/mm at the modulation m=50%) is indicated in the following Table 1.

TABLE 1

| Structure | Lines at m = 50% |
|---|---|
| 1 | 41 |
| 2 | 56 |
| 3 (invention) | 50 |
| 4 (invention) | 57 |

Table 1 shows that, with the conventional arrangement of the layers according to structure 1, much poorer sharpness is obtained than with the arrangement of a blue-sensitive layer beneath the green-sensitive layers.

The speed of the blue-sensitive, the green-sensitive and the red-sensitive layers and also the colour separation ΔF are indicated in the following Table 2.

TABLE 2

| Structure | Speed[1] blue | green | red | Colour separation ΔF[2] |
|---|---|---|---|---|
| 1 | 35.9 | 35.4 | 35.0 | 10.5 |
| 2 | 27.2 | 36.1 | 35.4 | 11.5 |
| 3 (invention) | 31.2 | 35.6 | 35.6 | 7.0 |
| 4 (invention) | 31.0 | 34.2 | 35.1 | 10.0 |

[1]Relative logarithmic values are given. An increase in the value by 3.0 corresponds to doubling of the speed.

[2]The colour separation ΔF is a logarithmic measure of the extent to which not only the blue-sensitive layers but, highly undesirably, also the green-sensitive layers are affected during exposure with blue light. The higher the ΔF value, the better the colour separation.

Table 2 shows that the layer structure 2 has a very low speed in the blue range of the spectrum as expected. This is due to the fact that, in order to enter the slow blue-sensitive layer $B_{11}$, the blue light has to pass not only through the layers $B_{12}$ and F in which a proportion of the blue light is absorbed anyway, but also through the layers $G_{12}$ and $G_{11}$ coloured yellow due to a content of the mask coupler. If, according to structures 3 and 4, a precursor compound which absorbs less blue light is used in layers $G_{12}$ and $G_{11}$, more blue light reaches layer $B_{11}$. Much higher speed is therefore achieved in structure 3. The colour separation may be improved by increasing the yellow density of the yellow filter layer, as with structure 4.

We claim:

1. A color photographic recording material, having a layer support, at least one blue-sensitive, at least one red-sensitive and at least one green-sensitive silver halide emulsion layer, at least one blue-sensitive silver halide emulsion layer being located between the layer support and at least one green-sensitive silver halide emulsion layer (G) wherein at least one compound corresponding to at least one of the following formulae is contained in the layer (G) or in a layer adjacent thereto:

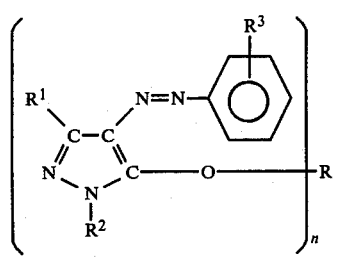

(I)

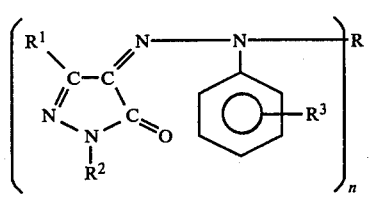

(II)

-continued (III)

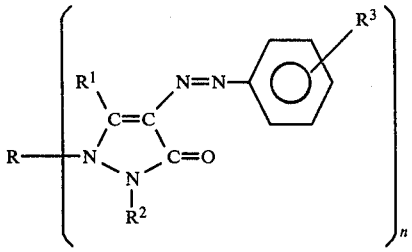

(IV)

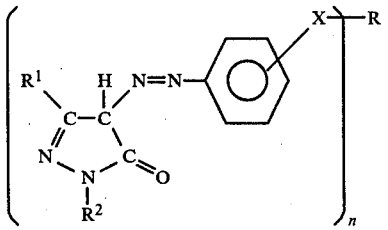

wherein $R^1$ to $R^3$ represent substituents usual for yellow mask couplers in photographic materials, X represents —O—, —$NR^4$— or —S— in the ortho or para position.

$R^4$ represents alkyl or hydrogen, n represents 1 or 2, and

R represents a monovalent or divalent acyl radical.

2. A material according to claim 1, wherein the improvement comprises R is a monovalent or divalent acyl radical of a carboxylic or sulphonic acid, of a carbonic acid or of a carbonic acid derivative.

3. A material according to claim 2, wherein the improvement comprises R is an acyl radical of an aliphatic carboxylic acid containing from 2 to 5 carbon atoms or a benzoyl radical or a radical capable of being split off from the rest of the compound by an intramolecular nucleophilic displacement reaction.

4. A material according to claim 1, wherein the improvement comprises the compound is contained in a quantity of from 50 mg to 250 mg per mol of silver halide.

5. A material according to claim 1, wherein the improvement comprises at least one of the following compounds is contained:

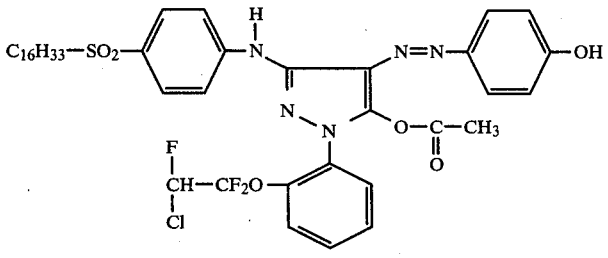

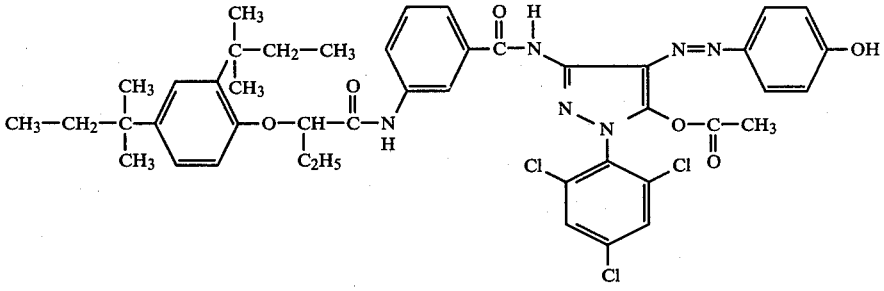

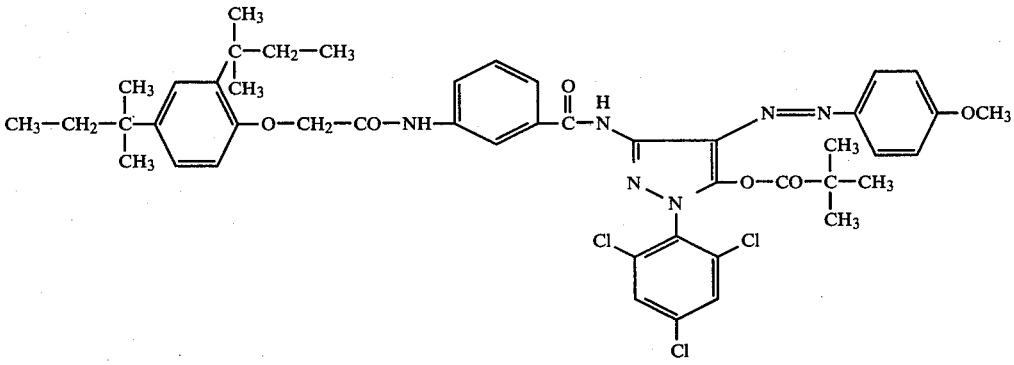

6. A material according to claim 1, wherein the improvement comprises a relatively high speed blue-sensitive layer is arranged above the green-sensitive layer (G) and a comparatively low-speed blue-sensitive layer is arranged beneath the layer (G).

* * * * *